United States Patent [19]

Weihe

[11] 4,076,554

[45] Feb. 28, 1978

[54] APPARATUS AND METHOD FOR DISPLAYING THE COST OF OPERATION OF A COMMERCIAL DISHWASHING MACHINE

[76] Inventor: Clyde R. Weihe, 17 Lindbergh Ave., Needham, Mass. 02192

[21] Appl. No.: 737,348

[22] Filed: Nov. 1, 1976

[51] Int. Cl.[2] ..... B08B 3/02

[52] U.S. Cl. ..... 134/10; 134/18; 134/29; 134/30; 134/60; 134/72; 134/113

[58] Field of Search ..... 134/10, 18, 25 A, 29, 134/30, 60, 72, 113; 73/195

[56] References Cited

U.S. PATENT DOCUMENTS

| | | | |
|---|---|---|---|
| 2,370,210 | 2/1945 | Turner | 73/195 |
| 3,319,637 | 5/1967 | Gore et al. | 134/72 X |
| 3,896,827 | 7/1975 | Robinson | 134/10 |

*Primary Examiner*—Richard V. Fisher
*Attorney, Agent, or Firm*—Richard L. Stevens

[57] ABSTRACT

A cost monitoring system for a dishwashing operation is disclosed. The pumps and/or valves through which the water flows in a dishwashing operation are monitored. Monitoring devices provide outputs on identical cost basis. These outputs are combined and a visual display provided of the cost attendant to the dishwashing operation.

9 Claims, 1 Drawing Figure

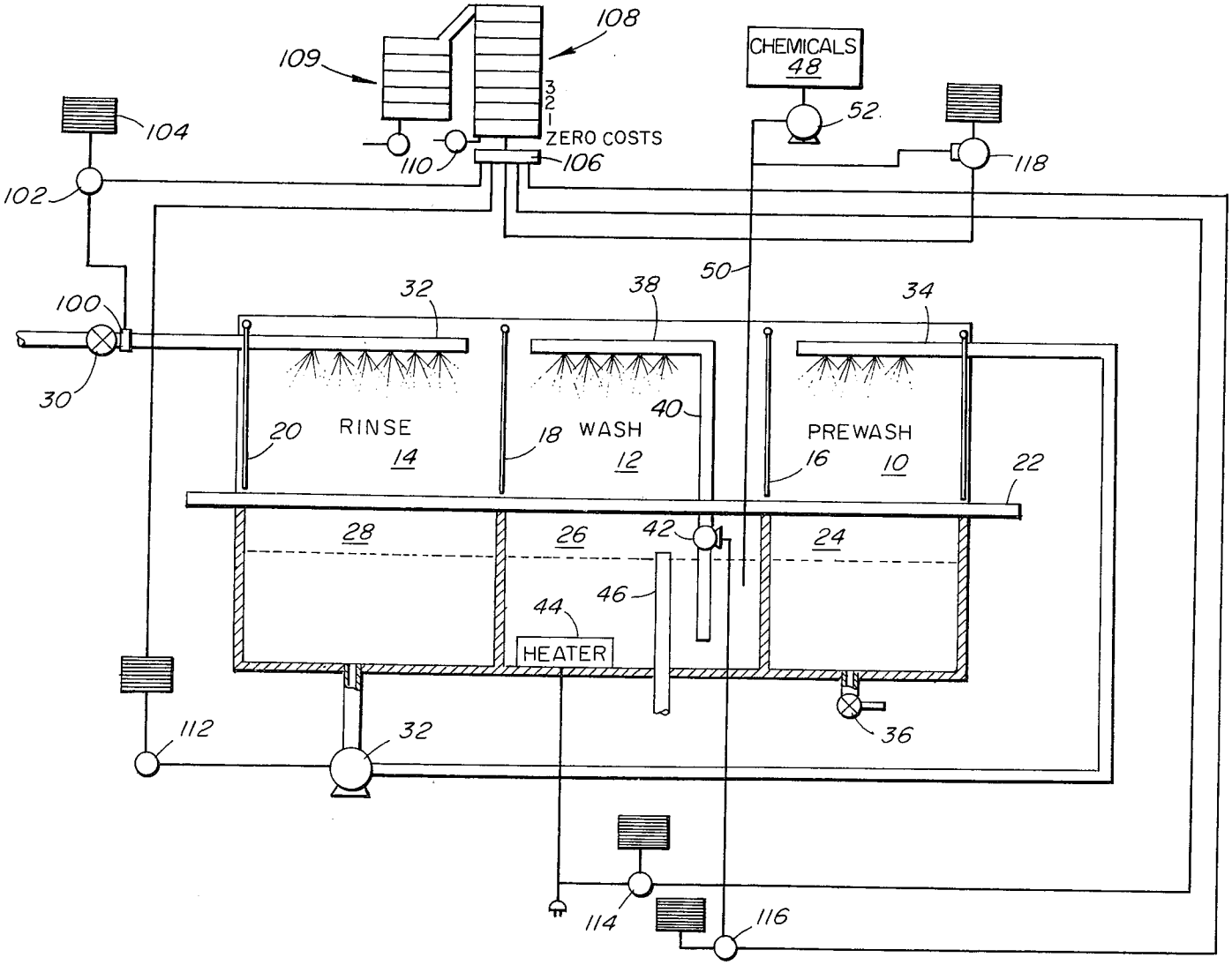
CHEMICALS
48
52
118
108
109
110
106
ZERO COSTS
3
2
1
104
102
100
30
50
34
38
32
PREWASH
10
WASH
12
RINSE
14
16
18
20
22
24
26
28
40
42
46
44
HEATER
36
32
112
114
116

APPARATUS AND METHOD FOR DISPLAYING THE COST OF OPERATION OF A COMMERCIAL DISHWASHING MACHINE

BACKGROUND AND BRIEF SUMMARY OF THE INVENTION

Commercial dishwashing machines commonly follow a cleaning cycle of prewash, wash and rinse. This is generally true whether the objects being cleaned are flatwear, crockery, pots, pans, etc. Typically, chemicals (detergents) are pumped to the machine for the wash portion of the cleaning cycle.

At the present time, in many installations where commercial dishwashing machines and the like are used, the only cost controls normally analyzed are those attendant with the original purchase price of the equipment and that paid for the chemicals. The frequency of use of a commercial dishwashing machine has not normally been monitored because it has been felt that the costs attendant with such operation are not significant. Thus, in many cases, an entire cleaning cycle will be initiated for a few pieces of flatwear, a half dozen pieces of crockery, or maybe one or two pots and pans and the like.

These dishwashing machines consume water, power and chemicals. More specifically, power, generally in the form of electricity, is required to drive the conveyor which transports the articles to be cleaned; to drive the pumps for moving water from one portion of the machine to another; and to heat the water.

In a typical commercial dishwashing machine, there are at least three zones: a prewash zone, a wash zone and a rinse zone. A primary water system provides hot water at about 180° F. through a valve, such as a solenoid valve, to the nozzle in the rinse zone. This valve may also supply make-up water to the washing and prewash zones. The water drained from the rinse zone is collected in a sump and pumped to the prewash zone through a nozzle and collected in a sump and discharged.

The wash zone typically includes a reservoir of water and an immersion heater to maintain the water at a proper temperature. Water is pumped from this reservoir through a nozzle and is sprayed in the wash zone in combination with chemicals to clean the articles. A stand pipe or other device allows the water to drain off when it reaches a certain level.

Commodities consumed for the various steps in the operation of a dishwashing machine include, but are not limited to, water, chemicals, electric current to drive the motor of the conveyor to pump the water from one zone to the other and to pump the chemicals into the wash zone; energy, gas or electric, is required to generate the primary source of heated water; and a pump is also required for spraying in the wash zone. Also, electric current is required for the immersion All of these consumed commodities comprise substantially the total cost of the operation of a commercial dishwashing machine. The personnel normally operating such equipment are salaried and do not generally have any incentive to reduce the cost incurred by management in such an operation. It has been found, however, that if a cost reduction system is initiated, that some visual indicia of the continuing costs attendant with such operations is ver instrumental in making the operators of such equipment more aware of the costs involved. However, where the cost of the machine operation is based on intermittant time usage, it is desirable to determine the total cost of operation of such a machine for a single cleaning cycle and for a plurality of cleaning cycles.

The present invention provides a system for measuring the cost of commodities consumed by a commercial dishwashing machine and a method of displaying on a real-time or current basis the actual cost of the commodities being consumed during and after a cleaning cycle.

The present invention in one embodiment is directed to an apparatus and method wherein each distinct commodity consumed is measured to provide an output representative of the cost of each commodity consumed. These outputs are provided on a cost per unit time basis. Further, regardless of the type of input, the outputs are on a common basis, and are totalled to reflect the cost during and at the end of each cleaning cycle.

In the preferred embodiment of the invention, a plurality of metering pumps are responsive to the commodities consumed, i.e., the flow of water and chemicals; and/or the power consumed by the pumps, motors and/or heaters during the entire cleaning cycle. Each of the metering pumps provides a colored liquid output representative of the cost of the commodity consumed which flows to a totalizing device, such as a clear graduated cylinder. Each of the metering devices is calibrated such that the fluid metered is volumetrically consistent with all other outputs.

My invention broadly comprises a dishwashing system having a plurality of zones, in which articles are prewashed in a first zone, washed in a second zone, and rinsed in a third zone. A first nozzle is provided to introduce heated water into the rinse zone. A second nozzle is provided to introduce heated water and chemicals into the wash zone. A first measuring device determines the cost of the heated water introduced into the rinse zone and provides a visual output of said cost. A second measuring device determines the cost of the water and chemicals introduced into the wash zone and provides an output of said costs. The fluid volume of the second output based on cost of commodity consumed is compatible with the output of the first measuring device on the same basis. The outputs are combined and reflect the total cost on a common scale.

BRIEF DESCRIPTION OF THE DRAWING

The drawing is a schematic illustration of a commercial dishwashing system in combination with a cost display system of the invention.

DESCRIPTION OF THE PREFERRED EMBODIMENT

Although the invention will be described in reference to a commercial dishwashing machine, the inventive principles are applicable to any device or apparatus which consumes various commodities on a continuous, continual, and/or intermittant timed basis. It is particularly applicable to devices where the commodities consumed provide at least two distinct different output characteristics, such as measuring fluid flow, temperature and/or power consumed, which outputs are converted in metering devices to outputs on the same calibrated basis such that all outputs may be combined directly to provide a visual display of the total cost of the operation of the device.

Referring to the drawing, a commercial dishwashing machine is shown and comprises three zones, a prewash zone 10, a wash zone 12, and a rinse zone 14. The zones are separated by flexible curtains 16, 18 and 20. Articles to be cleaned are carried successively and continuously through these zones in racks which are connected together and move around an oval track in a well-known manner. The curtains 16, 18 and 20 are pushed aside by the racks as they pass but form a sufficient separation of the compartments to allow the various steps to be performed at different temperatures. In this disclosure, the term cleaning cycle includes three separate steps: prewash, wash and rinse. A conveyor 22 carries the racks (not shown). A series of sump tanks 24, 26 and 28 are each arranged below the zones 10, 12 and 14.

A primary water supply enters the system through a solenoid valve 30 into a spray nozzle 32 in the rinse zone 14. This water is normally preheated to about 180° F. by a conventional water heater (not shown). The same valve may be used to provide make-up water for the prewash and wash zones 10 and 12.

Water draining from the rinse zone 14 is collected in the sump 28, is drawn from the sump 14 by a pump 32, and is transported to a spray nozzle 34 in the prewash zone 10. The prewash water which drains into the sump 24 is discharged by a valve 36.

The washing zone 12 has a spray nozzle 38 which receives water at about 150° F. from the sump 26 via a conduit 40, which water is transported by a pump 42. An immersion heater 44 in the sump maintains the wash water at the proper temperature. A stand pipe 46 allows water to drain off as it reaches a predetermined level. The chemicals necessary for the wash step are supplied to the nozzle 38 from a source 48 via a conduit 50 by a pump 52.

The washing machine thus far described is conventional and forms no part of the present invention. Further, certain conduits, valves and controls for the cleaning cycle have been omitted to avoid undue complexity of the drawing.

The commodities consumed for the cleaning cycle include the power required for: the pump 32 to transport the water from sump 28 to the nozzle 34 in the prewash zone 10; the pump 42 to transport the water from the sump 26 to the nozzle 38 in the wash zone 12; the heater 44 in the sump 26; the pump 52 for the chemicals; the hot water flowing through the solenoid valve 30; and the cost of the chemicals per se. In the present invention, each of these commodities are monitored and a visual display of the total cost of operation may be observed on a continuous basis.

The flow rate of the hot water through the valve 30 is measured. For example, it costs $0.03 to provide a flow rate of 6 gallons per minute of water at 180° F. A flow meter 100 is placed on line and an output provided to a proportioning pump 102 such as a positive displacement piston pump having a source of fluid 104. The pump 102 provides an output in fixed relation to the flow through the valve 30 which relates to cost. The specific fluid used is simply water to which a color additive has been added such as vegetable dye. The output from the pump 102 flows to a manifold 106 and into a clear cylinder 108 graduated in terms of cost as shown.

The cylinder 108 includes a petcock 110. Prior to start-up the cylinder is filled to zero level. The cylinder 108 is scaled on its outer surface such that a flow of 1 cc into the cylinder 108 would indicate a cost of $.01. Therefore, if the water at approximately 180° F. through the solenoid valve 30 is 6 gallons per minute and the total cost for 3 minutes is $0.09, then the proportioning pump 102 will meter into the graduated cylinder 108, nine (9) cc of the colored fluid, raising the level of fluid in the cylinder 108. The cylinder is scaled such that this volume of fluid would provide a reading of $0.09. Obviously, if the flow rate were only for a minute and a half, then only one-half the volume from the metering pump 102 would flow to the cylinder 108.

The chemicals used for the wash cycle flow from a source 48 through pump 52 via conduit 50 to the nozzle 38 in the wash zone 12. In a similar manner as described for monitoring the flow of fluid through the solenoid valve 30, a meter (not shown) is disposed downstream of the pump 52 in communication with a proportioning pump 118. For a wash cycle of 3 minutes, the pump 52 is actuated by the conventional controls of the dishwashing machine. Chemicals are pumped to the nozzle 38 at a flow rate of 5 cc per min. for a total cost of $0.03, which cost includes the cost of the chemicals and the cost of pumping the chemicals. The proportioning pump 118 is ratioed such that its liquid output (the liquid being identical to that used for proportioning pump 102) would be 3 cc. In this specific example, it would amount to 13 cc when combined with the liquid from the pump 102 in the cylinder 108. Thus, the total cost of the chemicals used in the wash zone and the hot water used in the rinse zone would be visually reflected.

An electrical signal from the pump 32 is provided to a proportioning pump 112 such as a positive displacement piston pump. Typically, the signal from pump 32 to pump 112 is provided such as by a contact to the motor lead wires. When the pump 32 is actuated in its normal manner during the cleaning cycle, the pump 112, upon receipt of the signal, provides an output of fluid identical to that for pumps 102 and 118. The pump 112 is calibrated to be on the same basis of volumetric output of metered liquids as pumps 102 and 118. For example, the cost of pumping water from the sump 28 to the nozzle 34 at a rate of 10 gallons per minute and for a time of 3 minutes is $0.003. This would result in the pump 112 producing an output to the manifold 106 and the calibrated cylinder of 0.3 cc. Thus, when the pump 32 is actuated as in normal sequence, pump 112 is actuated.

In a similar manner, when the heater 44 is actuated to maintain the temperature for the wash water, a pump 114 identical to the pump 112 but calibrated to provide the proper output is actuated. Specifically, if the cost for operating the heater is $0.03, over a four-minute period, then this will result in an output from the pump 114 of 3 cc to the graduated cylinder 108.

When the pump 42 is actuated to transport the water from the sump 26 to the nozzle 38 in the wash zone, a metering pump 116 is actuated, which pump is identical to pumps 112 and 114. If the cost for transporting the water over a time of three minutes is $0.01, then a metered output from the pump 116 of 1 cc will be introduced into the cylinder 108.

As the steps of prewash, wash and rinse continue, all the outputs from the proportioning pumps flow to the cylinder 108 where the total cost may be observed at any time during the cleaning cycle or at the end of the cycle. A second clear graduated cylinder 109 is adapted to receive the overflow from the cylinder 108, whereby the total cost may continue to be recorded. More specifically, when the liquid reaches a predetermined level in the cylinder 108, it automatically spills into the second cylinder 109 and records total operating costs.

The above invention has been described in reference to its application to commercial dishwashing systems. Specifically, metering devices such as proportioning pumps have been disclosed, two of which are directly responsive to the flow of fluid through a conduit and three of which are disclosed as being responsive to an electrical output required to drive pumps and operate a heater. Although it is possible all input may be electrical, fluid flow or a combination thereof, it is important that the pumps be calibrated such as to provide an output on a basis which is common to each of the outputs of the other metering pumps. That is, the volume output metered per cost consumed must be the same. That is, if a volume of 3 cc equals 1 dollar for one pump, then 3 cc must equal 1 dollar for all other pumps. Further, it is within the scope of my invention that where it is desirous only to measure two or more variables in the cost of commodities consumed rather than the total amount of commodities consumed in the system, the invention is equally applicable.

Having described my invention, what I now claim is:

1. A dishwashing system comprising:

a. means to define a plurality of zones including a prewash zone, a wash zone and a rinse zone;

b. means to introduce heated water into the rinse zone;

c. means to introduce heated water into the wash zone;

d. first measuring means in communication with the means to introduce the heated water into the rinse zone to determine the cost of the water so introduced and to provide a first liquid volumetric output of said cost;

e. second measuring means in communication with the means to introduce the heated water into the wash zone to determine the cost of the water so introduced and to provide a second liquid volumetric output of said cost, the basis of the output of the second measuring means being identical with the basis of the output of the first measuring means; and, f. means to combine the first and second liquid volumetric outputs and to reflect visually the total cost in a common scale.

2. The dishwashing system of claim 1 wherein the means to provide the liquid volumetric outputs are proportioning pumps.

3. The dishwashing system of claim 2 wherein the means to combine the outputs includes a calibrated receptacle.

4. The dishwashing system of claim 1 wherein the means to introduce the heated water into the rinse zone includes a valve, and the first measuring means includes means to monitor the flow of water through the valve and to provide a volumetric liquid output corresponding to the cost of the water passing through the valve.

5. The dishwashing system of claim 4 wherein the means to introduce the water into the wash zone includes a first pump and the second measuring means includes a proportioning pump in communication with the first pump to provide the volumetric output corresponding to the cost of the water pumped into the wash zone.

6. The dishwashing system of claim 5 which includes:

a. means to introduce water from the rinse zone to the prewash zone;

b. third measuring means in communication with the means to introduce the water into the prewash zone to determine the cost of the water introduced into the prewash zone and to provide a third liquid volumetric output of said cost, the basis of the third output being identical with the basis of the outputs of the first and second measuring means; and, c. means to combine the third output with the first and second outputs and to reflect visually the total cost in a common scale.

7. The system of claim 6 which includes:

a. means to introduce chemicals into the wash zone;

b. fourth measuring means in communication with said means to introduce chemicals into the wash zone to determine the cost of the chemicals introduced into the wash zone; and means to provide a fourth liquid volumetric output from the fourth measuring means and means to combine said fourth output with the outputs with the first, second and third measuring means, said fourth output being identical with the bases of the outputs of the first, second and third measuring means.

8. A method for monitoring the amount of costs attendant with a dishwashing operation where there is at least a wash step and a rinse step wherein articles to be cleaned are sequentially washed and rinsed in a wash zone and a rinse zone respectively, and pumps and valves provide for the movement of liquids through nozzles to effect the washing and rinsing of the articles, which method includes:

placing articles to be cleaned in a wash zone;

introducing water and chemicals into the wash zone;

contacting the articles to be cleaned with the water and chemicals;

measuring the cost of water and chemicals used to clean the articles;

providing a first liquid volumetric output corresponding to the cost of said water and chemicals;

transporting the articles from the wash zone to the rinse zone;

providing rinse water at a predetermined temperature to rinse said articles;

contacting the articles to be rinsed with the rinse water;

providing a second liquid volumetric output corresponding to the cost of the water used to rinse the articles, the basis of the cost of the water used in the rinse zone being identical to the basis of the cost of the water and chemicals used in the wash zone;

combining the first and second liquid volumetric outputs in a common receptacle; and displaying visually the combined volume to reflect the total cost.

9. The method of claim 8 wherein the dishwashing operation includes a prewash zone and which includes:

pumping the water from the rinse zone to the prewash zone;

measuring the amount of water pumped from the rinse zone to the prewash zone;

providing a third liquid volumetric output corresponding to the cost required to pump the water from the rinse zone to the prewash zone, the basis of said third output being identical to the basis of the first and second outputs of the rinse zone and wash zone; and combining said third output with the first and second outputs of the wash and rinse zones in the common receptacle.

* * * * *